US005242887A

United States Patent [19]

Usui

[11] Patent Number: 5,242,887

[45] Date of Patent: * Sep. 7, 1993

[54] THERMAL TRANSFER IMAGE-RECEIVING MATERIAL

[75] Inventor: Hideo Usui, Kanagawa, Japan

[73] Assignee: Fuji Photo Film Co., Ltd., Kanagawa, Japan

[ * ] Notice: The portion of the term of this patent subsequent to Mar. 24, 2009 has been disclaimed.

[21] Appl. No.: 705,204

[22] Filed: May 24, 1991

[30] Foreign Application Priority Data

May 25, 1990 [JP] Japan ..... 2-136266

[51] Int. Cl.[5] ..... B41M 5/035; B41M 5/38

[52] U.S. Cl. ..... 503/227; 428/195; 428/421; 428/422; 428/913; 428/914

[58] Field of Search ..... 8/471; 428/195, 421, 428/422, 913, 914; 503/227

[56] References Cited

U.S. PATENT DOCUMENTS 4,937,224 6/1990 Yamagishi et al. ..... 503/227

5,098,883 3/1992 Aono ..... 503/227

*Primary Examiner*—B. Hamilton Hess

*Attorney, Agent, or Firm*—Sughrue, Mion, Zinn, Macpeak & Seas

[57] ABSTRACT

Disclosed is a thermal transfer image-receiving material comprising a support which has thereon an image-receiving layerr for receiving a dye transferred by heat application from a application from a thermal transfer dye-donating material and for forming an image. The image receiving layer comprises a fluorine-containing high-molecular weight compound, a fluorine-containing surfactant, and a matting agent. Such a transfer material produces a printed color image which has excellent clarity and resolution.

8 Claims, No Drawings

THERMAL TRANSFER IMAGE-RECEIVING MATERIAL

FIELD OF THE INVENTION

The present invention relates to a thermal transfer image-receiving material for use in thermal transfer recording. More particularly, it relates to a thermal transfer image-receiving material which, when used in a thermal transfer recording together with a thermal transfer dye-donating material, does not suffer heat fusion to the dye-donating material. The image-recording material can be kept in close contact with the dye-donating material during the thermal transfer, producing no abnormality in the resulting image.

BACKGROUND OF THE INVENTION

With the rapid growth of the information industries, various information-processing systems have recently been developed and recording techniques and apparatuses suited for each information-processing system have been developed and adopted. Thermal transfer recording, which is one such recording technique, is advantageous in that the equipment therefor is light-weight, compact, and noiseless and its operation and maintenance are easy. Further, this recording technique is easily applicable to color recording, and it has consequently been extensively used in recent years.

This thermal transfer recording technique is roughly divided into two types, a thermal fusion type and a thermal transfer type. In the latter technique, a thermal transfer dye-donating material comprising a support having a dye-donating layer containing a binder and a heat-transfer dye is superposed on a thermal transfer image-receiving material. Heat is applied from the support side of the dye-donating material, thereby transferring the heat-transfer dye to the recording medium (thermal transfer image-receiving material) in accordance with the heat pattern applied to obtain a transferred image.

The heat-transfer dye discussed is a dye which can transfer from a thermal transfer dye-donating material to a thermal transfer image-receiving material by means of sublimation or diffusion into the medium.

However, the thermal transfer image-receiving material used in the thermal transfer recording techniques of this type has the following problems. When the thermal transfer image-receiving material is superposed on a thermal transfer dye- donating material and the heat-transfer dye is transferred to the image-receiving material by heat application, the two materials are fused often to each other and, as a result, difficulties are encountered in peeling the two materials from each other after thermal transfer. Additionally, there are cases in which even if the two materials are readily peeled from each other, the surface layer of the dye-donating material been coated with the dye-donating layer adheres to the image-receiving material surface, resulting in impaired image quality or making the conveyance of the image-receiving material within the printer difficult. This trouble arises frequently, particularly when thermal transfer is conducted at an increased applied voltage and an elevated temperature in order to obtain a sufficient transfer density.

Further, there is another problem that when the thermal transfer image-receiving material is not kept in close contact with the thermal transfer dye-donating material during thermal transfer, part of the dye-donating material which is in the form of a thin sheet leaves its original position relative to the image-receiving material and produces wrinkles. These wrinkles cause streaks in the resulting transferred image, i.e., the image has recording unevenness or abnormality. Although incorporation of a fluorine-containing compound is effective in preventing heat fusion and improves the close-contact property, fluorine-containing high-molecular weight compounds which particularly improve the close-contact property have poor compatibility with various high-molecular weight compounds which are useful as image-receiving material, especially with polyester resins. Because of this drawback, there has been the problem that with an image-receiving material having a coating of a blend of such a fluorine-containing high-molecular weight compound and a polyester series resin, the coating suffers phase separation on the surface thereof, resulting in formation of minute specks, loss of gloss, etc.

SUMMARY OF THE INVENTION

An object of the present invention is to provide a thermal transfer image-receiving material which is for use in a thermal transfer recording and is free of the conventional problems mentioned above.

Other objects and effects of the present invention will be apparent from the following description.

The above-described problems have been eliminated by a thermal transfer image-receiving material comprising a support having thereon an image-receiving layer for receiving a dye transferred by heat application from a thermal transfer dye-donating material and forming an image, the image-receiving layer containing a fluorine-containing high-molecular weight compound, a fluorine-containing surfactant, and a matting agent.

DETAILED DESCRIPTION OF THE INVENTION

Examples of the fluorine-containing high-molecular weight compound employed in the present invention include those described in U.S. Pat. Nos. 4,175,969, 4,087,394, 4,016,125, 3,676,123, 3,679,411, and 4,304,852, JP-A-52-129520 (the term "JP-A" as used herein means an "unexamined published Japanese patent application"), JP-A-54-158222, JP-A-55-57842, JP-A-57-11342, JP-A-57-19735, JP-A-57-179837, "Kagaku Sosetsu (The Elements of Chemistry) No. 27, New Fluorine Chemistry" (edited by Nihon Kagakukai, Japan, 1980), "Functional Fluorine-Containing Polymers" (edited by Nikkan Kogyo Shinbun-sha, Japan, 1982), etc.

These fluorine-containing high-molecular weights compounds may be produced according to the methods described in the above-enumerated references. Further, they can generally be synthesized by fluorination of the corresponding hydrocarbons. A detailed description of fluorination of hydrocarbons is given in "Shin Jikken Kagaku Koza (Lectures on New Experimental Chemistry)" vol. 14 (I) (Maruzen, Japan, 1977) pp. 308–331.

The fluorine-containing high-molecular weight compound is incorporated in the image-receiving layer of the image-receiving material, together with the fluorine-containing surfactant and the matting agent of the present invention described hereinafter. The amount of the fluorine-containing high-molecular weight compound incorporated in the image-receiving layer is in an amount of generally from 0.001 to 3 $g/m^2$, preferably from 0.002 to 1.5 g/m$^2$, more preferably from 0.005 to 1.0 g/m$^2$, based on the surface are of the side of the material. Furthermore, the fluorine-containing high-molecular weight compound may be incorporated in the other constituent layer(s).

Specific examples of the fluorine-containing high-molecular weight compound are given below, but the fluorine-containing high-molecular weight compounds of the present invention are not limited thereto.

F-1
$$\left(CH_2-\underset{\substack{|\\ COOC_8F_{17}}}{CH}\right)_m\left(CH_2\underset{\substack{|\\ COOC_4H_9}}{CH}\right)_n$$

F-2
$$\left(CH_2-\underset{\substack{|\\ COOC_8F_{17}}}{CH}\right)_m\left(CH_2\overset{\substack{CH_3\\ |}}{\underset{\substack{|\\ COOC_4H_9}}{CH}}\right)_n$$

F-3
$$\left(CH_2\underset{\substack{|\\ COOC_6F_{13}}}{CH}\right)_m\left(CH_2\underset{\substack{|\\ COOC_4H_9}}{CH}\right)_n$$

F-4
$$\left(CH_2\underset{\substack{|\\ COOC_8F_{16}H}}{CH}\right)_m\left(CH_2\underset{\substack{|\\ COOC_4H_9}}{CH}\right)_n$$

F-5
$$\left(CH_2\underset{\substack{|\\ COOC_8F_{16}H}}{CH}\right)_m\left(CH_2\overset{\substack{CH_3\\ |}}{\underset{\substack{|\\ COOC_4H_9}}{CH}}\right)_n$$

F-6
$$\left(CF_2CF_2\right)_m\left(CF_2\underset{\substack{|\\ OC_3F_7}}{CF}\right)_n$$

F-7
$$\left(CH_2CH_2\right)_m\left(CF_2CF_2\right)_n$$

F-8
$$\left(CH_2CH_2\right)_m\left(CF_2-\underset{\substack{|\\ CF_3}}{CF}\right)_n$$

F-9
$$\left(CH_2\underset{\substack{|\\ CH_3}}{CH}\right)_m\left(CF_2-CF\right)_n$$

F-10
$$\left(\underset{\substack{|\\ CF_3}}{N}-O\ CF_2CF_2\right)_n$$

F-11
$$\left(\overset{\substack{CH_3\\ |}}{\underset{\substack{|\\ CH_2CH_2CF_3}}{Si}}O\right)_n$$

F-12
$$\left(\overset{\substack{OCH_2CF_3\\ |}}{\underset{\substack{|\\ OCH_2(CF_2)_3CF_2H}}{P}}=N\right)_n$$

In the above formulae, m and n each represents an integer of 8 to 1,000. These average molecular weights are 1,000 to 60,000. Among them, F-1, F-2, F-3, F-4 and F-5 are especially preferred.

The fluorine-containing surfactant employed in the present invention is a surfactant containing a fluorinated hydrocarbon moiety. It may be an anionic, cationic, nonionic, and betaine type, or an other type. Nonionic types of fluorine-containing surfactants are preferred. Examples of the fluorine-containing surfactants are shown below, but the fluorine-containing surfactant of the present invention is not limited thereto:

(A-1) $CH_3-(CF_2)_5-CO_2NH_4$ (A-2) $CF_3-(CF_2)_3-(CH_2)_{10}-CO_2Na$ (A-3) $CF_3-(CF_2)_6-CON-\underset{\substack{|\\ C_2H_5}}{(CH_2)_2}-SO_3K$ (A-4) 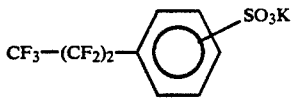

(A-5) $CF_3-(CF_2)_7-SO_3K$ (A-6) $CF_2-(CF_2)_{11}-CH_2-OSO_3Na$ (A-7) $H(CH_2)_6-CH_2O(CH_2)_3-SO_3Na$ (A-8) $\begin{array}{l} CH_2-CO_2CH_2-(CF_2)_6H \\ |\\ NaO_3S-CH-CO_2CH_2-(CF_2)_6H \end{array}$ (A-9) $\begin{array}{l} CH-CO(OC_2H_4)_4-O-CH-CO_2CH_2CF_2CF_2H \\ |\qquad\qquad\qquad\qquad |\\ CH-CO_2K\qquad\qquad CH_2-CO_2CH_2CF_2CF_2H \end{array}$ (A-10) $H-(CF_2)_{10}-CO_2Na$ (A-11) $Cl(CF_2-\underset{\substack{|\\ Cl}}{CF})_3CF_2-CO_2K$ (A-12) $CF_3-(CF_2)_6-CH=CH-(CH_2)_3-CO_2Na$ (A-13) $CF_3-(CF_2)_3\underset{\substack{|\\ CF_3}}{CF}-(CH_2)_{10}-CO_2Na$ (A-14) 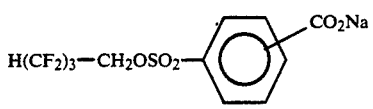

(A-15) $CF_3-(CF_2)_7-\underset{\substack{|\\ CH_3}}{CON}-(CH_2)_2-CO_2Na$ (A-16) $Cl(CF_2)_6-CO_2Na$ (A-17) $CF_3-(CF_2)_3CH_2CH_2SO_3\underset{\substack{|\\ C_2H_5}}{N}-CH_2CO_2Na$ (A-18) $CF_2(CF_2)_7-SO_2\underset{\substack{|\\ C_2H_5}}{N}-CH_2CO_2K$ (A-19) $CF_3(CF_2)_7-SO_2\underset{\substack{|\\ C_3H_7}}{N}-CH_2CO_2K$ (A-20) $C_{16}H_{33}-\underset{\substack{|\\ SO_2Na}}{CH}-CO_2CH_2CF_2$ (A-21) $C_{16}H_{33}-\underset{\substack{|\\ SO_3Na}}{CH}-CONHCH_2-(CF_2)_2H$ (A-22) $CF_3-\overset{\substack{C_2F_5\\ |}}{\underset{\substack{|\\ C_2F_5}}{C}}-\overset{\substack{CF_3\\ |}}{\underset{\substack{|\\ CH_2O(CH_2CH_2O)_7H}}{CHF}}-CH_3$ (A-23) $CF_3-\overset{\substack{C_2F_5\\ |}}{\underset{\substack{|\\ C_2F_5}}{C}}-\overset{\substack{CF_3\\ |}}{\underset{\substack{|\\ CO_2(CH_2CH_2O)_4H}}{CHF}}-CF_3$ -continued

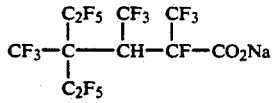

(A-24)

$CF_3-(CF_2)_7SO_2N(C_2H_5)-C_2H_4O-(C_2H_4O)_{10}H$ (A-25)

$H(CF_2)_{10}-CH_2OH$ (A-26)

$CF_3-(CF_2)_6-CO_2(CH_2-CH(CH_3)-O)_4(CH_2CH_2O)_{20}H$ (A-27)

$CF_3-(CF_2)_7SO_2N(CH_3)-CH_2CH_2OSO_3Na$ (A-28)

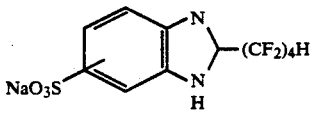

(A-29)

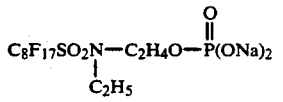

(A-30)

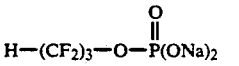

(A-31)

$CF_3-(CF_2)_{12}-CO_2-(C_2H_4O)_{20}H$ (A-32)

$CF_3-(CF_2)_6-CON(CH_3)-C_2H_4O-(C_2H_4O)_{20}H$ (A-33)

$F(CF(CF_3)-CF_2O)_2-CF(CF_3)-CONH(CH_2)_3CON(CH_3)_2$ (A-34)

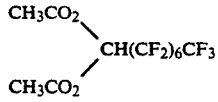

(A-35)

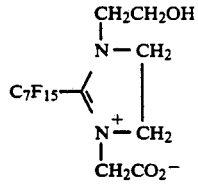

(A-36)

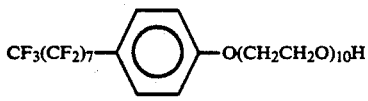

(A-37)

$H-(CF_2)_6-CH_2O-(CH_2CH_2O)_{10}H$ (A-38)

$H-(CF_2)_6-CH_2O-(CH_2CH_2O)_{20}H$ (A-39)

$H-(CF_2)_6-CH_2O-(CH_2CH(OH)-CH_2O)_2-(CH_2CH_2O)_5H$ (A-40)

$CF_3(CF_3)_7-SO_2-NHCH_2CH_2-N^{\oplus}(CH_2CH_3)_2-CH_2COO^{\ominus}$ (A-41)

$CF_3(CF_3)_7SO_3NH(CH_2)_3-N^{\oplus}(CH_2)_3.I^{\ominus}$ (A-42)

-continued

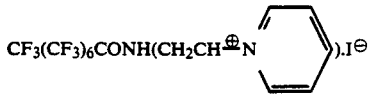

(A-43)

$CF_3(CF_3)_6CONH(CH_2)_3N^{\oplus}(CH_3)_2-CH_2CH_2COO^{\ominus}$ (A-44)

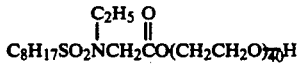

(A-45)

Among them, Fluorine-containing surfactant A-25, A-27, A-33, A-37, A-38, A-39, and A-40 are more preferred.

Further, examples of the fluorine-containing surfactant further include Megafac F-141 to F-144, F-170 to F-173, F-180 to F-184, F-192 to F-195, and F-522 manufactured by Dainippon Ink & Chemicals, Incorporated, Japan; Surflon S-111 to S-113, S-131 to S-133, S-141, S-101, S-105, S-381, and S-382 manufactured by Asahi Glass Co., Ltd., Japan; and Ftergent 400S manufactured by NEOS Company Limited, Japan.

The amount of the fluorine-containing surfactant incorporated in the image-receiving layer is preferably from 0.001 to 1 g/m$^2$, more preferably from 0.005 to 0.5 g/m$^2$.

The matting agent employed in the present invention is in the form of fine particles. It is necessary that the agent not dissolve in the solvent and other ingredients of the material or be deformed when the image-receiving layer is formed by coating. Examples of the matting agent include the compounds shown in JP-A-61-88256, p. 29, such as silicon dioxide, polyolefins, and polymethacrylates, and further include the compounds shown in JP-A-62-110064 and JP-A-62-110065, such as benzoguanamine resin beads, polycarbonate resin beads, and AS resin beads. Fine particles comprised of polyethylene, polypropylene or poly(fluorinated carbon) are preferred.

The particle average diameter of the matting agent is generally from 0.01 to 20 μm, preferably from 0.1 to 10 μm. The amount of the matting agent incorporated in the image-receiving layer is preferably from 0.01 to 1.0 g/m$^2$, more preferably from 0.05 to 0.5 g/m$^2$.

Since the compatibility between the fluorine-containing high-molecular weight compound of the present invention and and the high-molecular weight compounds of an image-receiving material (for instance a polyester binder) is not good, it is desirable that in preparing the coating fluid, the fluorine-containing high-molecular weight compound be incorporated thereinto in the form of fine dispersion, after being finely divided along with the fluorine-containing surfactant and the matting agent by means of a dispersing device such as a disperser, homogenizer, mill, or the like, so as to be finely dispersed in the coating fluid.

As the support for use in the thermal transfer image-receiving material of the present invention, any support is appropriate provided that it can withstand transfer temperatures and satisfy requirements of smoothness, whiteness, slip properties, abrasion properties, antistatic properties, depression after thermal transfer, etc. Examples of the support include: paper supports such as synthetic papers (e.g., polyolefin-based or polystyrene-based synthetic papers), wood-free paper, art paper, coat paper, cast-coated paper, wall paper, backing paper, papers impregnated with synthetic resins or emulsions, papers impregnated with synthetic rubber latexes, synthetic resin-internally-added papers, fiber board, cellulose fiber paper, and polyolefin-coated papers (particularly, papers coated on both sides with polyethylene); films or sheets of various plastics such as polyolefins, poly(vinyl chloride), poly(ethylene terephthalate), polystyrene, methacrylate plastics, and polycarbonates; films or sheets obtained by imparting whiteness and reflecting properties to such plastic films or sheets; and laminates comprising any combination of layers selected from the above papers and plastic films and sheets.

The image-receiving layer provided in the thermal transfer image-receiving material of the present invention is a coating containing a heat-transfer dye-accepting substance (The image-receiving layer is an outermost layer), which may be used alone or in combination with other binder substance(s). Preferably, the image-receiving layer has a thickness of about from 0.5 to 50 μm.

This heat-transfer dye-accepting substance accepts a heat-transfer dye transferred in printing from the thermal transfer dye-donating material, and is thereby dyed with the heat-transfer dye. Examples of the heat-transfer dye-accepting substance include the following resins.

(A) Ester bond-containing resins

Polyester resins obtained by the condensation of a dicarboxylic acid such as terephthalic acid, isophthalic acid, succinic acid, or the like (these dicarboxylic acids may be substituted with a sulfone group, carboxyl group, etc.) with ethylene glycol, diethylene glycol, propylene glycol, neopentyl glycol, bisphenol A, or the like; polyacrylate or polymethacrylate resins such as poly(methyl methacrylate), poly(butyl methacrylate), poly(methyl acrylate), and poly(butyl acrylate); polycarbonate resins; poly(vinyl acetate) resins; styrene-acrylate resins; vinyltoluene-acrylate resins; and the like. Examples of these resins are given in JP-A-59-101395, JP-A-63-7971, JP-A-63-7972, JP-A-63-7973, and JP-A-60-294862. Further, ester bond-containing resins usable in the present invention are commercially available under the trade names of Vylon 290, Vylon 200, Vylon 280, Vylon 300, Vylon 103, Vylon GK-140, Vylon GK-130 (produced by Toyobo Co., Ltd., Japan), ATR-2009, ATR-2010 (produced by Kao Corporation, Japan), and others;

(B) Urethane bond-containing resins

Polyurethane resins and the like;

(C) Amide bond-containing resins

Polyamide resins and the like;

(D) Urea bond-containing resins Urea resins and the like;

(E) Sulfone bond-containing resins

Polysulfone resins and the like;

(F) Resins containing other highly polar bonds

Polycaprolactone resins, styrene-maleic anhydride resins, poly(vinyl chloride) resins, polyacrylonitrile resins, and the like.

In addition to the above-enumerated synthetic resins, mixtures or copolymers thereof may also be used.

Among them, ester bond-containing resins are preferred and polyester resins, polyacrylester resins, polycarbonate resins and poly(vinylacetate-vinylchloride) copolymer are more preferred.

A high-boiling point organic solvent or a heat solvent may be incorporated, as a heat-transfer dye-acceptable substance or a dye-diffusion aid, in the thermal transfer image-receiving material, particularly in the image-receiving layer.

Examples of the high-boiling point organic solvent and heat solvent include the compounds mentioned in JP-A-62-174754, JP-A-62-245253, JP-A-61-209444, JP-A-61-200538, JP-A-62-8145, JP-A-62-9348, JP-A-62-30247, and JP-A-62-136646.

The image-receiving layer in the thermal transfer image-receiving material of the present invention may have a constitution in which the heat-transfer dye-acceptable substance is dispersed in a water-soluble binder and supported thereby. This water-soluble binder may be any of various known water-soluble polymers, but those having a group that can undergo a crosslinking reaction with the aid of a film-hardening agent are preferred. Of these, gelatin is particularly preferred.

The image-receiving layer may be comprises two or more layers. In this case, it is preferable that the layer situated nearer to the support be formed by a synthetic resin having a low glass transition point or by a high-boiling point organic solvent or heat solvent so as to have a constitution having enhanced dyeability. The outermost layer is preferably formed by a synthetic resin having a higher glass transition point or by minimum amount of a high-boiling point organic solvent or heat solvent or omitting such a solvent. This constitution prevents such troubles as surface tackiness, adhesion to other substances, retransfer to other substances after thermal transfer, and blocking with a thermal transfer dye-donating material. The image-receiving layer present as an outermost layer contains the fluorine-containing high-molecular weight compound, the fluorine-containing surfactant, and the matting agent in each amount aforementioned as being appropriate The thickness of the image-receiving layer as a whole is in the range of preferably from 0.5 to 50 μm, more preferably from 3 to 30 μm. In the case of two-layer constitution, the outermost layer thickness is in the range of preferably from 0.1 to 2 μm, more preferably from 0.2 to 1 μm.

The thermal transfer image-receiving material of the present invention may have an intermediate layer between the support and the image-receiving layer.

According to its composition, the intermediate layer may function as a cushioning layer, a porous layer, or a dye diffusion-preventive layer. In some cases, the intermediate layer also functions as a dye-fixing agent.

A dye diffusion-preventive intermediate layer serves, in particular, to prevent a heat-transfer dye from diffusing into the support. The binder constituting this diffusion-preventive layer may be water-soluble or organic solvent-soluble, but a water-soluble binder is preferred. Examples thereof include the water-soluble binders mentioned hereinabove with respect to the binder for the image-receiving layer. Of these, gelatin is especially preferred.

A porous intermediate layer serves to prevent heat applied for thermal transfer from diffusing from the image-receiving layer to the support, thereby contributing to effective utilization of applied heat.

The image-receiving layer, cushioning layer, porous layer, diffusion-preventive layer, adhesive layer, etc. which constitute the thermal transfer image-receiving material of the present invention may contain a fine powder of, for example, silica, clay, talc, diatomaceous earth, calcium carbonate, calcium sulfate, barium sulfate, aluminum silicate, synthetic zeolite, zinc oxide, lithopone, titanium oxide, alumina, or the like.

A fluorescent brightener may be used in the thermal transfer image-receiving material. Examples thereof include the fluorescent brightener compounds mentioned in "The Chemistry of Synthetic Dyes" vol. 5, chapter 8, edited by K. Veenkataraman, and JP-A-61-143752. Specifically, examples of the fluorescent brightener include stylbene-type compounds, coumarin-type compounds, biphenyl-type compounds, benzoxazolyl-type compounds, naphthalimide-type compounds, pyrazoline-type compounds, carbostyryl-type compounds, 2,5-dibenzooxazolthiophene-type compounds, and the like.

Such a fluorescent brightener may be used in combination with an anti-fading agent.

There are two types of thermal transfer dye-donating materials which can be used together with the image-receiving material of the present invention: (1) a thermal transfer dye-donating material comprising a support having thereon a layer containing a heat-transfer dye, which is transferred, in accordance with the pattern of the applied heat, to the image-receiving layer of the thermal transfer image-receiving material to thereby complete a recording; and (2) a thermal transfer dye-donating material comprising a support having thereon a layer of a heat-fusible ink, which is fused, in accordance with the pattern of applied heat, and transferred to the thermal transfer image-receiving material to thereby complete a recording.

The support for the thermal transfer dye-donating material may be any of the conventionally known supports. Examples thereof include poly(ethylene terephthalate), polyamides, polycarbonates, glassin paper, capacitor paper, cellulose esters, fluoropolymers, polyethers, polyacetals, polyolefins, polyimides, poly(phenylene sulfide), polypropylene, polysulfone, cellophane, and the like.

The thickness of the support in the thermal transfer dye-donating material is generally from 2 to 30 μm. If necessary, an undercoat layer may be applied to the support. Further, a dye diffusion-preventive layer consisting of a hydrophilic polymer may be provided between the support and the dye-donating layer. This serves to further improve transfer density. As the hydrophilic polymer, any of the above-enumerated water-soluble polymers may be used.

For the purpose of preventing a thermal head from sticking to the dye-donating material, a slipping layer may be provided. This slipping layer is composed of a lubricating substance which may or may not contain a polymer binder. The lubricating substance, for example, may be a surfactant, a solid or liquid lubricant, or a mixture thereof.

The thermal transfer dye-donating material employing a heat-transfer dye basically comprises a support having thereon a thermal transfer layer containing a binder and a dye that sublimes or becomes movable upon heating. This thermal transfer dye-donating material can be obtained by dissolving or dispersing a conventionally known dye that sublimes or becomes movable upon heating and a binder resin in a suitable solvent to prepare a coating fluid. This coating fluid is applied on one side of a support for a conventionally known thermal transfer dye-donating material at such a spread rate as to result in a dry coating thickness of, for example, about from 0.2 to 5 μm, preferably from 0.4 to 2 μm. The applied coating is then dried to form a thermal transfer layer.

The dye useful in the formation of such a thermal transfer layer includes any of those conventionally used for thermal transfer dye-donating materials. However, those having molecular weights as low as about 150 to 800 are particularly preferred in the present invention. In selecting a suitable dye, transfer temperature, hue, light fastness, solubility or dispersibility in ink and binder resin, etc. are to be taken in account.

Examples of the dye include disperse dyes, basic dyes, oil-soluble dyes, and the like. Particularly preferred are Sumicalon Yellow E4GL, Dianix Yellow H2G-FS, Miketone Polyester Yellow 3GSL, Kayaset Yellow 937, Sumicalon Red EFBL, Dianix Red ACE, Miketone Polyester Red FB, Kayaset Red 126, Miketone Fastbrilliant Blue B, Kayaset Blue 136, and the like. In addition to these, other known heat-transfer dyes can be used.

As the binder resin for use with the above dye, any of the binder resins conventionally know as binder for this purpose can be used. Normally, a resin which has good heat resistance and does not hinder the transfer of the dye when heated is selected. Examples of the binder resin include polyamide resins, polyester resins, epoxy resins, polyurethane resins, polyacrylic resins (e.g., poly(methyl methacrylate), polyacrylamide, and poly(styrene-2-acrylonitrile)), vinyl resins including polyvinylpyrrolidone, poly(vinyl chloride) resins (e.g., vinyl chloride-vinyl acetate copolymers), polycarbonate resins, polystyrene, poly(phenylene oxide), cellulose resins (e.g., methyl cellulose, ethyl cellulose, carboxymethyl cellulose, cellulose acetate hydrogen phthalate, cellulose acetate, cellulose acetate propionate, cellulose acetate butyrate, and cellulose triacetate), poly(vinyl alcohol) resins (e.g., poly(vinyl alcohol) and partly saponified poly(vinyl alcohol)s such as poly(vinyl butyral)), petroleum resins, rosin derivatives, coumarone-indene resins, terpene resins, polyolefin resins (e.g., polyethylene and polypropylene), and the like.

It is preferable that such a binder resin be used in an amount of, for example, from about 80 to about 600 parts by weight per 100 parts by weight of the dye.

As the ink solvent for dissolving or dispersing the above-described dye and binder resin, any of conventionally known ink solvents may be used without particular limitation.

For the purpose of preventing a thermal head from sticking to the dye-donating material due to heating when the thermal head is applied to the back side of the dye-donating material and thereby enhancing smooth movement of the thermal head, it is preferable that the side of the support on which a dye-donating layer has not been provided be subjected to sticking-preventive treatment.

For example, a heat-resistant slip layer is preferably applied which consists mainly of (i) a product of reaction between a poly(vinyl butyral) resin and an isocyanate, (ii) an alkali metal salt or alkaline earth metal salt of a phosphoric ester, and (iii) a filler. Preferably, the poly(vinyl butyral) resin has a molecular weight of about 60,000 to 200,000 and a glass transition temperature of 80° to 110° C. Further, from the standpoint of increasing the number of reaction sites that take part in the reaction with the isocyanate, the resin preferably is one in which the content of the vinyl butyral moieties is from 15 to 40% by weight. As the alkali metal salt or alkaline earth metal salt of a phosphoric ester, Gafac RD720 produced by Toho Chemical Industry Co., Ltd., Japan or the like is used generally in an amount of about from 1 to 50% by weight, preferably about from 10 to 40% by weight, based on the amount of the poly(-vinyl butyral) resin.

It is desirable that the lower layer of the heat-resistant slip layer possess heat resistance. This may be attained by applying to the lower layer a coating consisting of a combination of a thermoset synthetic resin and a hardener therefor, for example, a combination of poly(vinyl butyral) and a polyisocyanate, a combination of an acrylic polyol and a polyisocyanate, a combination of cellulose acetate and a titanium chelating agent, or a combination of a polyester and an organotitanium compound.

According to need, a hydrophilic barrier layer may be provided in the dye-donating material in order to prevent diffusion of the dye toward the support. This hydrophilic dye-barrier layer contains a hydrophilic substance useful for the intended purpose. In general, good results are obtained by use of gelatin, polyacrylamide, poly(isopropylacrylamide), butyl methacrylate-grafted gelatin, ethyl methacrylate-grafted gelatin, cellulose monoacetate, methyl cellulose, poly(vinyl alcohol), poly(ethylene imine), poly(acrylic acid), a mixture of poly(vinyl alcohol) and poly(vinyl acetate), a mixture of poly(vinyl alcohol) and poly(acrylic acid), or a mixture of cellulose monoacetate and poly(acrylic acid). Particularly preferred of these are poly(acrylic acid), cellulose monoacetate, and poly(vinyl alcohol).

An undercoat layer may be provided in the dye-donating material. This undercoat layer may have any constitution as long as the dye-donating material produces the desired effects when used along with the image-receiving material of the present invention. Preferred examples of the material for the undercoat layer include an acrylonitrile-vinylidene chloride-acrylic acid copolymer (14:80:6 by weight); a butyl acrylate-2-aminoethyl methacrylate-2-hydroxyethyl methacrylate copolymer (30:20:50 by weight); linear saturated polyesters, e.g., Bostic 7650 (Emhurt Company, Bostic Chemical Group); and chlorinated high-density poly-(ethylene-trichloroethylene) resins. The amount of the undercoat layer applied is not particularly limited, but is normally from 0.1 to 2.0 g/m$^2$.

In the second embodiment of the thermal transfer dye-donating material for use in conjunction with the present invention, the thermal transfer layer is a heat-fusible transfer layer formed from a thermal transfer layer-forming ink comprising a wax which contains a colorant such as a dye or a pigment. This ink is prepared by incorporating and dispersing a colorant selected from carbon black and various dyes and pigments into a wax. The wax functions as a binder, having a proper melting point, for example, a paraffin wax, microcrystalline wax, carnauba wax, or urethane wax. The proportion of the colorant to wax used is preferably in such a range that the colorant comprises about from 10 to 65% by weight of the resulting heat-fusible transfer layer. The preferred range of the thickness of the transfer layer formed is about from 1.5 to 6.0 μm. Preparation of the ink and application thereof on a support may be conducted according to known techniques.

In forming the dye-donating layer, dyes are suitably selected so as to produce a desired hue through transfer printing. If necessary, two or more dye-donating layers containing different dyes may be arranged side by side in a single thermal transfer dye-donating material. For example, in the case where an image like a color photograph is to be formed by repeated printing of each color according to color-separation signals, it is desirable that the printing produce a cyan, magenta, and yellow color and thus three dye-donating layers containing dyes providing such hues be arranged side by side. Alternatively, a dye-donating layer containing a dye giving a black hue may be provided in addition to the dye-donating layers providing cyan, magenta, and yellow hues. It is preferable that when these dye-donating layers are formed, a marking for a location search be provided simultaneously, since this eliminates the necessity of an ink-printing step which must be conducted separately from the dye-donating layer formation.

For the purpose of improving releasability between the thermal transfer dye-donating material and the thermal transfer image-receiving material of the present invention, it is preferable to incorporate a release agent in the layers constituting the dye-donating material and/or the image-receiving material, particularly preferably in that outermost layer of each material at which the materials come to contact with each other.

Any of conventionally known release agents can be used. Examples thereof include solid release agents or wax-like substances such as polyethylene wax, amide wax, silicone resin fine powder, and fluoroplastic fine powder; surfactants of the fluorine-containing type, phosphate type, or other types; oils of the paraffin type, silicone-type, or fluorine-containing type; and the like. Of these, a silicone oil is particularly preferred. The silicone oil may be unmodified or modified such as a carboxy-modified, amino-modified, epoxy-modified, polyether-modified or alkyl-modified silicone oil. These silicone oils may be used alone or in combination of two or more thereof Examples of such silicone oils include the various modified silicone oils described in "Modified Silicone Oils" pp. 6–18B, issued from Shin-Etsu Silicone Co., Ltd., Japan. For use in an organic solvent-based binder, an amino-modified silicone oil is effective which has a group that is reactive to a crosslinking agent for the binder (e.g., a group reactive to an isocyanate). On the other hand, a carboxy-modified silicone oil (e.g., trade name X-22-3710, manufactured by Shin-Etsu Silicone Co., Ltd.) or an epoxy-modified silicone oil (e.g., trade name KF-100T, manufactured by Shin-Etsu Silicone Co., Ltd.) is effective if the silicone oil is dispersed and emulsified in a water-soluble binder.

Each of the layers constituting the thermal transfer image-receiving material of the present invention and constituting the thermal transfer dye-donating material to be used with the image-receiving material may have been cured by a film-hardening agent.

In the case of curing organic solvent-based polymers, the film-hardening agents described in JP-A-61-199997, JP-A-58-215398, etc. can be used. Isocyanate-type film-hardening agents are particularly preferred for polyester resins.

To cure water-soluble polymers, the film-hardening agents described in U.S. Pat. No. 4,678,739, column 41, JP-A-59-116655, JP-A-62-245261, JP-A-61-18942, etc. are preferable. Examples of such hardeners include aldehyde-type film-hardening agents (e.g., formaldehyde), aziridine-type film-hardening agents, epoxy-type film-hardening agents (e.g.,

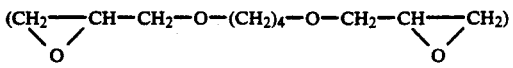

vinylsulfone-type film-hardening agents (e.g., N,N'-ethylenebis(vinylsulfonylacetamido)ethane), N-methylol-type film-hardening agents (e.g., dimethylolurea), and high-molecular film-hardening agents (e.g., the compounds given in JP-A-62-234157).

An anti-fading agent may be used in the thermal transfer dye-donating material or the thermal transfer image-receiving material. Examples of the anti-fading agent, include an antioxidant, an ultraviolet absorber, or a metal complex of a certain kind.

Exemplary antioxidants include chroman-type compounds, coumaran-type compounds, phenol-type compounds (e.g., hindered phenols), hydroquinone derivatives, hindered amine derivatives, and spiroindane-type compounds. In addition, the compounds shown in JP-A-61-159644 are also effective.

Exemplary ultraviolet absorbers include benzotriazole-type compounds (U.S. Pat. No. 3,533,794 etc.), 4-thiazolidone-type compounds (U.S. Pat. No. 3,352,681 etc.), benzophenone-type compounds (JP-A-56-2784 etc.), and the compounds shown in JP-A-54-48535, JP-A-62-136641, JP-A-61-88256, etc. In addition, the ultraviolet- absorbing polymers described in JP-A-62-260152 are also effective.

Exemplary metal complexes include the compounds shown in U.S. Pat. No. 4,241,155, U.S. Pat. No. 4,245,018, columns 3–36, U.S. Pat. No. 4,254,195, columns 3–8, JP-A-62-174741, JP-A-61-88256, pp. 27–29, JP-A-1-75568, JP-A-63-199248, and Japanese Patent Application No. 62-230596, etc.

Examples of useful anti-fading agents are given in JP-A-62-215272, pp. 125–137.

The anti-fading agent for preventing the fading of the dye transferred to the image-receiving material may have been incorporated beforehand in the image-receiving material, or it may be fed to the image-receiving material by, for example, transferring the anti-fading agent from the dye-donating material.

The above-described antioxidant, ultraviolet absorber, and metal complex may be used in combination of two or more thereof.

Various surfactants may be used for the constitutional layers of the thermal transfer dye-donating material and the thermal transfer image-receiving material, to improve coating properties, releasability, slip properties, or antistatic properties or to accelerate development, or for other purposes.

Nonionic surfactants, anionic surfactants, ampholytic surfactants, and cationic surfactants may be used. Specific examples thereof are shown in JP-A-62-173463, JP-A-62-183457, etc.

Further, use of a surfactant as a dispersing agent is preferred when a heat-transfer dye-accepting substance, release agent, anti-fading agent, ultraviolet absorber, fluorescent brightener, and other hydrophobic compounds are dispersed in a water-soluble binder. In addition to the above surfactants, those shown in JP-A-59-157636, pp. 37–38 are particularly preferable for this purpose.

An organofluorine compound may be incorporated in the constituent layers of the thermal transfer dye-donating material or the thermal transfer image-receiving material to improve slip properties, antistatic properties, releasability, etc. Representative examples of the organofluorine compound include the fluorine-containing surfactants given in JP-B-57-9053, columns 8–17 (the term "JP-B" as used herein means an "examined Japanese patent publication"), JP-A-61-20944, JP-A-62-135826, etc., fluorine-containing oily compounds such as fluorine-containing oils, and fine powders of fluoroplastics such as polytetrafluoroethylene resins. Incorporation of a silicone oil containing a polyether group is also effective for the above purpose. Further, the combination of a polyether-modified silicone oil and a fluoroplastic fine powder is also effective.

By use of the thermal transfer image-receiving material of the present invention in combination with the above-described thermal transfer dye-donating material, a printed color image with good gradation can be obtained, which also has excellent clarity and resolution. That is, the dye-donating material is superposed on the image-receiving material, and heat energy according to image information is applied from either side of the superposed materials, preferably from the back side of the dye-donating material, by a heating means such as, for example, a thermal head, thereby transferring the dye from the dye-donating layer to the image-receiving material in accordance with the magnitude of the applied heat energy, to print a color image with good gradation and excellent clarity and resolution.

The heating means is not limited to thermal head, and other know heating means can be used, such as a laser light (e.g., semiconductor laser), an infrared flash, a hot pen, and the like.

In combination with a thermal transfer dye-donating material, the thermal transfer image-receiving material of the present invention can be utilized in various printers of the thermal printing type; facsimile; image printing by means of a magnetic, optomagnetic, or optical recording technique or the like; image printing from television or CRT pictures; or in other applications.

With respect to details of thermal transfer recording techniques, reference may be made to the related description in JP-A-60-34895.

As described above, the present invention is an excellent thermal transfer image-receiving material to which a thermal transfer dye-donating material does not heat-fuse during thermal transfer printing, and which is good in the property of maintaining close contact with the dye-donating material during thermal transfer printing. Hence, the image-receiving material never causes any abnormality such as streaks or specks in the resulting printed image.

The present invention is explained below in more detail with reference to the following Example and Comparative Example, but the Example should not be construed as limiting the scope of the invention.

EXAMPLE AND COMPARATIVE EXAMPLE

Preparation of thermal transfer image-receiving materials and thermal transfer dye-donating materials, printing by use of both materials, and examination of the thermal transfer image-receiving materials were conducted as follows.

Preparation of Thermal Transfer Dye-Donating Material

As a support, a 6 μm-thick polyester film (manufactured by Teijin Limited, Japan) was used which had been coated on one side with a heat-resistant slip layer formed from a thermosetting acrylic resin. This support was coated, side by side on the side opposite to the heat-resistant slip layer side, with each dye-donating layer-forming ink composition consisting of the following ingredients at a spread rate of 1.2 g/m$^2$ on a dry basis, thereby obtaining a dye-donating material.

| Cyan ink composition for forming dye-donating layer: | |
|---|---|
| Dye-a | 3 parts |
| Poly(vinyl butyral) resin (Denkabutyral 5000A, manufactured by Denki Kagaku Kogyo K.K., Japan) | 2.5 parts |
| Polyisocyanate (Takenate D110N, manufactured by Takeda Chemical Industries, Ltd., Japan) | 0.1 part |
| Amino-modified silicone oil (KF-857, manufactured by Shin-Etsu Chemical Industries Co., Ltd., Japan) | 0.004 part |
| Methyl ethyl ketone | 50 parts |
| Toluene | 50 parts |

Dye-a:

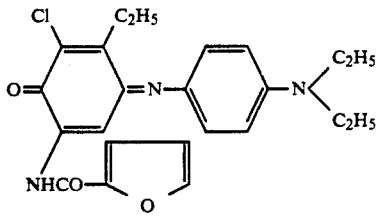

| Magenta ink composition for forming dye-donating layer: | |
|---|---|
| Dye-b | 2.5 parts |
| Poly(vinyl butyral) resin (S-Lecs BX-1, manufactured by Sekisui Chemical Co., Ltd., Japan) | 2.5 parts |
| Polyisocyanate (KP-90, manufactured by Dainippon Ink & Chemicals, Incorporated, Japan) | 0.1 part |
| Silicone Oil (KF-857, manufactured by Shin-Etsu Chemcial Industries Co., Ltd.) | 0.004 part |
| Methyl ethyl ketone | 70 parts |
| Toluene | 30 parts |

Dye-b:

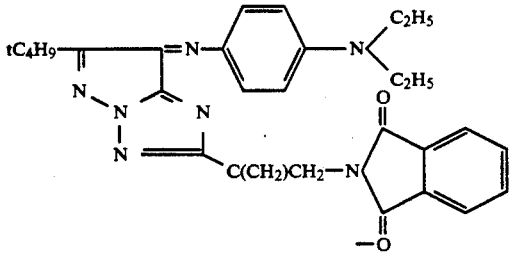

| Yellow ink composition for forming dye-donating layer: | |
|---|---|
| Dye-C | 5 parts |
| Ethyl cellulose | 3 parts |
| Methyl ethyl ketone | 50 parts |
| Toluene | 50 parts |

Dye-c:

-continued

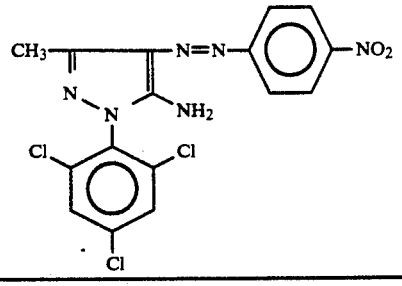

Preparation of Thermal Transfer Image-Receiving Material

Low-density polyethylene which had a thickness of 33 μm and into which titanium oxide and ultramarine had been kneaded was laminated to one side of a 175 μm-thick wood-free paper support. On the other side of the support, 32 μm-thick high-density polyethylene was laminated. Then, the resulting polyethylene-coated paper was coated, on the low-density polyethylene-laminated side, with a hydrophilic binder layer-forming composition (1) specified below at a spread rate of 1 g/m$^2$ in terms of gelatin amount.

| Composition (1) for forming hydrophilic binder layer: | |
|---|---|
| Gelatin | 60 g |
| Water | 3,000 g |
| Surfactant | 2.3 g |
| $C_4H_9CH(C_2H_5)OCOCH_2$ / $C_4H_9CH(C_2H_5)OCOCH—SO_3Na$ | |
| Thickening agent (potassium salt of poly(styrene sulfonic acid)) | 1.4 g |

On this hydrophilic binder layer, an image-receiving layer-forming Coating Composition (2) consisting of the ingredients shown below was applied by Gieser coating at a spread rate of 10 g/m$^2$ based on the surface area of the polyester. Thus, thermal transfer image-receiving materials (1) to (6) were prepared. The applied coating composition was air-dried in a draft and then dried in an oven at 100° C. for 30 minutes.

Coating composition (2) for forming image-receiving layer was prepared by dispersing the following ingredients in homogenizer at 1000 rpm for 5 minutes.

| Coating composition (2) for forming image-receiving layer: | |
|---|---|
| Polyester resin | 20 g |
| Isocyanate-type hardener (KP-90, manufactured by Dainippon Ink & Chemicals, Incorporated) | 3 g |
| Amino-modified silicone oil (KF-857, manufactured by Shin-Etsu Chemical Industries Co., Ltd.) | 0.5 g |
| Fluorine-containing high-molecular weight compound | shown in Table 1 |
| Fluorine-containing surfactant | shown in Table 1 |
| Matting agent | shown in Table 1 |
| Methyl ethyl ketone | 100 ml |

-continued

| Coating composition (2) for forming image-receiving layer: | |
|---|---|
| Toluene | 100 ml |

Composition of polyester resin (mol %):

| TPA | IPA | SIPA | BIS-A-ED | EG |
|---|---|---|---|---|
| 25 | 25 | 1 | 24.5 | 24.5 |

Molecular weight; about 20,000
TPA = terephthalic acid
IPA = isophthalic acid
SIPA =

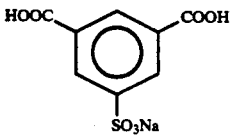

1: 0/10 to 1/10
2: 2/10 to 3/10
3: 4/10 to 6/10
4: 7/10 to 8/10
5: 9/10 to 10/10

Grade 1 means presence of 0 to 1 sheets with fusion per 10 sheets of black prints obtained by the thermal transfers.

For evaluation of the print surface for the presence or absence of abnormality, a gray print was formed at a pulse length of 8 msec and an emission density of about 1.2. Print surface abnormality was evaluated in 5 grades according to the frequency of abnormality occurrence, using the same criteria as in the fusion evaluation.

TABLE 1

| Sample No. | Fluorine-containing high-molecular weight compound | Amount ($g/m^2$) | Fluorine-containing surfactant | Amount ($g/m^2$) | Matting agent | Amount ($g/m^2$) | Fusion | Print surface abnormality Streak | Speck | Print surface |
|---|---|---|---|---|---|---|---|---|---|---|
| 1 (Comparison) | none | 0 | none | 0 | spherical polyethylene beads | 0.1 | 5 | 5 | 1 | glossy |
| 2 (Comparison) | F-1 | 0.05 | none | 0 | spherical polyethylene beads | 0.1 | 1 | 1 | 5 | with minute specks |
| 3 (Comparison) | none | 0 | A-25 | 0.05 | spherical polyethylene beads | 0.1 | 2 | 4 | 1 | glossy |
| 4 (Invention) | F-1 | 0.05 | " | 0.05 | spherical polyethylene beads | 0.1 | 1 | 1 | 1 | " |
| 5 (Invention) | F-2 | 0.05 | " | 0.05 | spherical polyethylene beads | 0.1 | 1 | 1 | 1 | " |
| 6 (Invention) | F-3 | 0.05 | " | 0.05 | spherical polyethylene beads | 0.1 | 1 | 1 | 1 | " |
| 7 (Invention) | F-1 | 0.05 | A-38 | 0.05 | spherical polyethylene beads | 0.1 | 1 | 1 | 1 | " |
| 8 (Invention) | F-1 | 0.05 | A-39 | 0.05 | spherical polypropylene beads | 0.1 | 1 | 1 | 2 | " |
| 9 (Invention) | F-1 | 0.10 | " | 0.10 | spherical polyethylene beads | 0.1 | 1 | 1 | 1 | " |
| 10 (Invention) | F-1 | 0.02 | " | 0.05 | spherical polyethylene beads | 0.1 | 1 | 2 | 1 | " |
| 11 (Invention) | F-1 | 0.02 | " | 0.05 | spherical polyethylene beads | 0.2 | 1 | 1 | 1 | " |
| 12 (Invention) | F-4 | 0.05 | A-38 | 0.05 | spherical polyethylene beads | 0.1 | 1 | 1 | 1 | " |
| 13 (Invention) | F-5 | 0.05 | " | 0.05 | spherical polyethylene beads | 0.1 | 1 | 1 | 1 | " |
| 14 (Invention) | F-6 | 0.05 | A-39 | 0.05 | spherical polyethylene beads | 0.1 | 2 | 1 | 2 | " |
| 15 (Invention) | F-7 | 0.05 | " | 0.05 | spherical polyethylene beads | 0.1 | 2 | 1 | 1 | " |

BIS-A-ED =

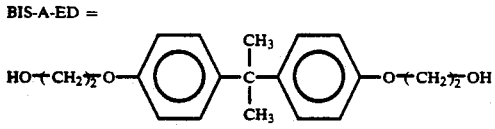

EG = ethylene glycol

The thus-obtained thermal transfer dye-donating material and thermal transfer image-receiving material were superposed on each other in such a manner that the thermal transfer layer was in contact with the image-receiving layer. A thermal head was applied thereto from the support side of the thermal transfer dye-donating material under conditions of thermal head output 0.25 W/dot, pulse length 0.2–15 msec, and dot density 6 dots/mm. Thus, thermal transfer was conducted in the order of yellow, magenta, and cyan at the same place to obtain a black print.

For evaluation of heat fusion, a black print was formed at a pulse length of 15 msec, and evaluation was made in 5 grades according to the frequency of fusion occurrence.

While the invention has been described in detail and with reference to specific embodiments thereof, it will be apparent to one skilled in the art that various changes and modifications can be made therein without departing from the spirit and scope thereof.

What is claimed is:

1. A thermal transfer image-receiving material comprising:

a support having thereon an image-receiving layer for receiving a dye transferred by heat application from a thermal transfer dye-donating material and for forming an image, said image-receiving layer comprising a heat-transfer dye-accepting substance, a fluorine-containing high-molecular weight compound, a fluorine-containing surfactant, and a matting agent in the form of fine particles.

2. The thermal transfer image-receiving material of claim 1, wherein the fluorine-containing high-molecular weight compound is a member selected from the group consisting of compounds F-1 to F-12 shown below:

F-1 $$\left(CH_2-\underset{\underset{COOC_8F_{17}}{|}}{CH}\right)_m\left(CH_2\underset{\underset{COOC_4H_9}{|}}{CH}\right)_n$$

F-2 $$\left(CH_2-\underset{\underset{COOC_8F_{17}}{|}}{CH}\right)_m\left(CH_2\overset{\overset{CH_3}{|}}{\underset{\underset{COOC_4H_9}{|}}{CH}}\right)_n$$

F-3 $$\left(CH_2\underset{\underset{COOC_6F_{13}}{|}}{CH}\right)_m\left(CH_2\underset{\underset{COOC_4H_9}{|}}{CH}\right)_n$$

F-4 $$\left(CH_2\underset{\underset{COOC_8F_{16}H}{|}}{CH}\right)_m\left(CH_2\underset{\underset{COOC_4H_9}{|}}{CH}\right)_n$$

F-5 $$\left(CH_2\underset{\underset{COOC_8F_{16}H}{|}}{CH}\right)_m\left(CH_2\overset{\overset{CH_3}{|}}{\underset{\underset{COOC_4H_9}{|}}{CH}}\right)_n$$

F-6 $$\left(CF_2CF_2\right)_m\left(CF_2\underset{\underset{OC_3F_7}{|}}{CF}\right)_n$$

F-7 $$\left(CH_2CH_2\right)_m\left(CF_2CF_2\right)_n$$

F-8 $$\left(CH_2CH_2\right)_m\left(CF_2-\underset{\underset{CF_3}{|}}{CF}\right)_n$$

F-9 $$\left(CH_2\underset{\underset{CH_3}{|}}{CH}\right)_m\left(CF_2-CF\right)_n$$

F-10 $$\left(\underset{\underset{CF_3}{|}}{N}-O\ CF_2CF_2\right)_n$$

F-11 $$\left(\overset{\overset{CH_3}{|}}{\underset{\underset{CH_2CH_2CF_3}{|}}{Si}}O\right)_n$$

F-12 $$\left(\overset{\overset{OCH_2CF_3}{|}}{\underset{\underset{OCH_2(CF_2)_3CF_2H}{|}}{P}}=N\right)_n$$

wherein m and n each represents an integer of 8 to 1,000.

3. The thermal transfer image-receiving material of claim 1, wherein the fluorine-containing surfactant is a member selected from the group consisting of surfactants A-25, A-27, a-33, A-37, A-38, A-39, and A-40 shown below:

$$CF_3-(CF_2)_7SO_2\underset{\underset{C_2H_5}{|}}{N}-C_2H_4O-(C_2H_4O)_{10}H \quad \text{(A-25)}$$

$$CF_3-(CF_2)_6-CO_2(CH_2-\underset{\underset{CH_3}{|}}{CH}-O)_4(CH_2CH_2O)_{20}H \quad \text{(A-27)}$$

$$CF_3-(CF_2)_6-CO\underset{\underset{CH_3}{|}}{N}-C_2H_4O-(C_2H_4O)_{20}H \quad \text{(A-33)}$$

(A-37)

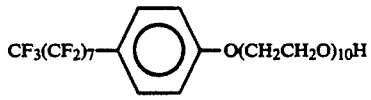

$$H-(CF_2)_6-CH_2O-(CH_2CH_2O)_{10}H \quad \text{(A-38)}$$

$$H-(CF_2)_6-CH_2O-(CH_2CH_2O)_{20}H \quad \text{(A-39)}$$

$$H-(CF_2)_6-CH_2O-(CH_2\underset{\underset{OH}{|}}{CH}-CH_2O)_2-(CH_2CH_2O)_5H \quad \text{(A-40)}$$

4. The thermal transfer image-receiving material of claim 1, wherein the heat-transfer dye-accepting substance is a member selected from the group consisting of ester bond-containing resins, polyurethane resins, amide bond-containing resins, urea bond-containing resins, sulfone bond-containing resins, and highly polar bond-containing resins.

5. The thermal transfer image-receiving material of claim 1, wherein the fluorine-containing high-molecular weight compound is from 0.001 to 3 g/m$^2$, the fluorine-containing surfactant is from 0.001 to 1 g/m$^2$, and the matting agent is from 0.01 to 1.0 g/m$^2$.

6. The thermal transfer image-receiving material of claim 1, which further comprises a cushioning layer, a porous layer, or a dye diffusion-preventive layer between said support and said image-receiving layer.

7. The thermal transfer image-receiving material of claim 1, wherein the matting agent is a polyethylene.

8. The thermal transfer image-receiving material of claim 1, wherein the matting agent is a polypropylene.

* * * * *